United States Patent [19]

Shirai

[11] Patent Number: 4,537,160

[45] Date of Patent: Aug. 27, 1985

[54] AIR CLEANER FOR AN AIR-COOLED ENGINE

[75] Inventor: Tetsuaki Shirai, Kobe, Japan

[73] Assignee: Kawasaki Jukogyo Kabushiki Kaisha, Kobe, Japan

[21] Appl. No.: 638,736

[22] Filed: Aug. 8, 1984

[30] Foreign Application Priority Data

Aug. 12, 1983 [JP] Japan ..... 58-125955[U]

[51] Int. Cl.[3] ..... F01P 5/06

[52] U.S. Cl. ..... 123/41.58; 123/41.65; 55/320; 55/385 B; 55/DIG. 28

[58] Field of Search ..... 123/41.59, 41.65, 41.7, 123/198 E, 198 D; 55/315, 318, 320, 385 B, 437, DIG. 28

[56] References Cited

U.S. PATENT DOCUMENTS 3,155,082 11/1964 Roorda et al. ..... 123/41.58

4,212,659 7/1980 Magrini ..... 55/385 B 4,233,043 11/1980 Catterson ..... 123/198 E 4,425,145 1/1984 Reese ..... 55/385 B

*Primary Examiner*—William A. Cuchlinski, Jr.

*Attorney, Agent, or Firm*—Marshall, O'Toole, Gernstein, Murray & Bicknell

[57] ABSTRACT

This disclosure relates to an air cleaner for use in an air-cooled engine including a cooling fan within a fan housing. The cleaner is connected to draw air from the housing, and includes a casing having a side wall, an air inlet opening in the fan housing, an air passage formed within the casing and extending from the inlet along the wall, the passage including a curved portion, and a narrow opening formed in the wall adjacent the curved portion. The curved passage causes dust particles to move by reason of inertia to the radially outer side of the passage and the particles are removed through the narrow opening.

7 Claims, 4 Drawing Figures

AIR CLEANER FOR AN AIR-COOLED ENGINE

BACKGROUND OF THE INVENTION

The present invention relates to an air cleaner for an air-cooled engine, and more particularly to an arrangement of an air passage for separating and removing dust from the air moving into the air cleaner.

When a multipurpose engine is used in a dusty environment or one containing lawn clippings or straw chips or the like, the filter element of the engine air cleaner for the combustion air becomes quickly loaded up with dust or other debris. As a result, the engine performance is reduced and it may even fail.

There has been provided a conventional air cleaner adapted to receive air from the engine cooling fan housing, which has relatively less dust. An air cleaner construction of this type is schematically shown in FIG. 1 of the accompanying drawings, and it is also disclosed in Japanese Patent Provisional Pub. 55-32980 claiming priority of U.S. Ser. No. 938,039 filed on Aug. 30, 1978 now U.S. Pat. No. 4,233,043.

In FIG. 1, a fan housing 1 encloses a fan 3 which rotates to produce a cooling wind delivered to the cylinder section and the main parts of the engine. In the side wall of the housing 1 is formed a straight air passage 4, through which passes a portion of the wind into the atmosphere. The passage 4 has an intermediate branch 6 extending perpendicularly thereto and leading to an air cleaner 5, which communicates with a carburetor 2. Dust in the air moving through the passage 4 is moved straight through the passage 4 and is discharged into the atmosphere by its inertia, whereas relatively clean air is sucked into the cleaner 5.

However, since the dust distribution in the air in the cross section of the passage 4 is even, a portion of the dust passing by the suction port 6*a* may be sucked into the branch 6 if the inertia of the dust particles is low. The inertia could be made larger by increasing the amount of the wind, but this would necessitate an enlargement of the size of the fan.

BRIEF SUMMARY OF THE INVENTION

It is a general object of this invention to provide a simple and compact air cleaner, which substantially reduces the loading of its filter element.

An air cleaner in accordance with the present invention is for use in an air-cooled engine including a cooling fan within a fan housing. The cleaner is adapted to draw air from the housing, and comprises a casing having a side wall, an air inlet opening in said fan housing, an air passage formed within said casing and extending from the inlet along the wall, the passage including a curved portion, and a narrow opening formed in the wall adjacent the curved portion.

BRIEF DESCRIPTION OF THE DRAWINGS

A preferred embodiment of the invention is shown in the accompanying figures of the drawings, wherein.

DETAILED DESCRIPTION OF THE PREFERRED EMBODIMENT

Figure 1:
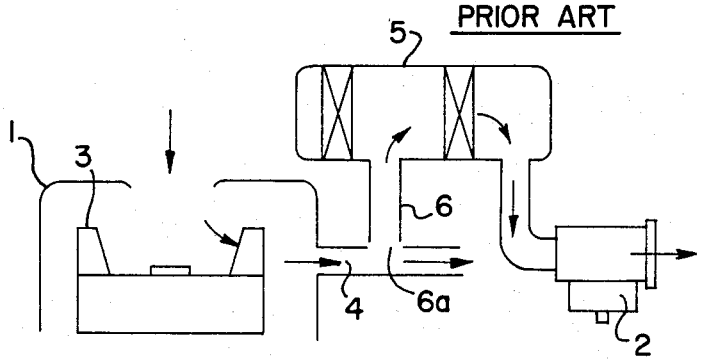
FIG. 1 PRIOR ART
FIG. 1 is a schematic diagram of a conventional combination fan housing and air cleaner.
Figure 2:
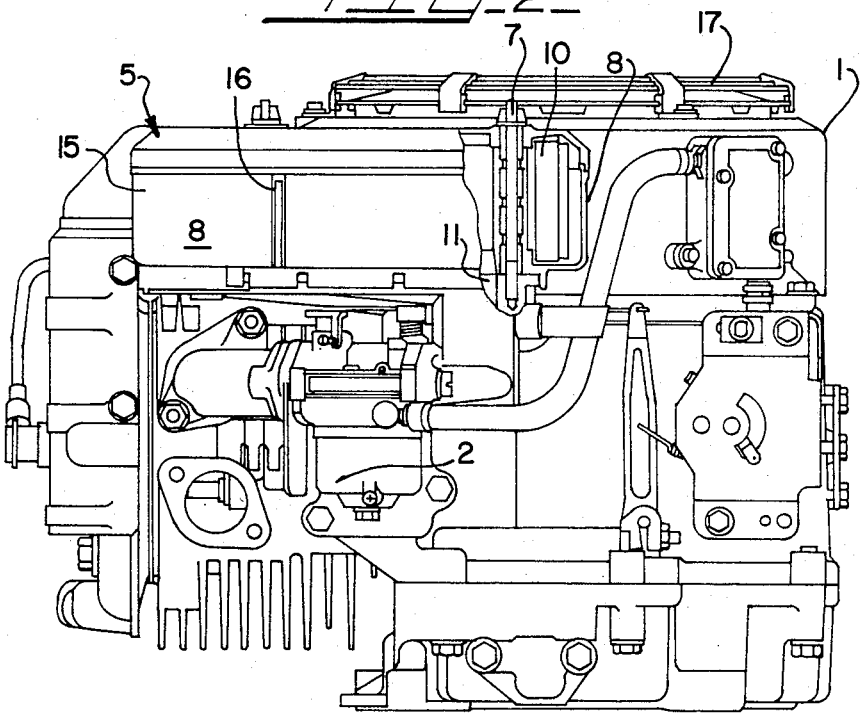
FIG. 2 is a side view of an engine embodying the invention.
Figure 3:
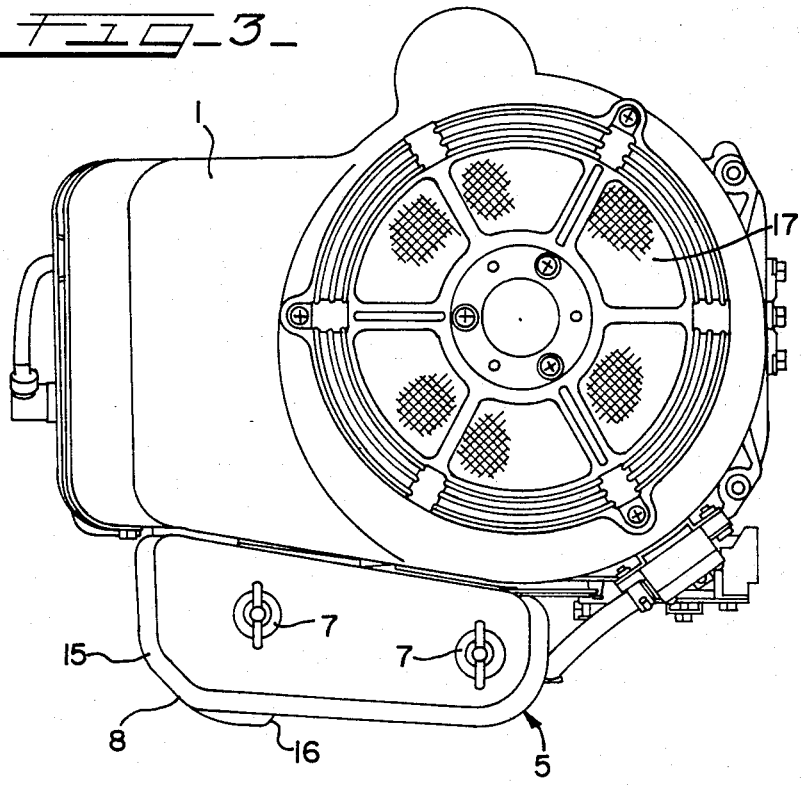
FIG. 3 is a top plan view of the engine shown in FIG. 2.
Figure 4:
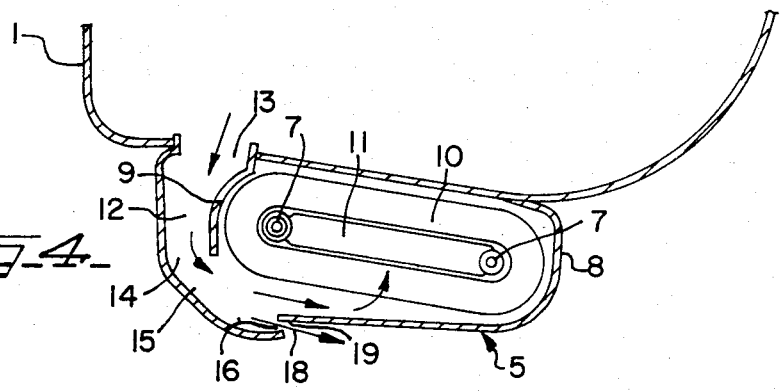
FIG. 4 is a schematic diagram illustrating the operation of the invention.

With reference to FIGS. 2–4, the engine includes a housing 1 that encloses a cooling fan (not shown) having substantially the same construction as a conventional fan arrangement. The fan in the housing 1 draws air downwardly through a top screened inlet opening 17 and produces cooling air for the engine parts.

On or adjacent one side wall of the housing 1 is mounted an air cleaner 5, which includes a casing 8, an air inlet opening 13 between the housing 1 and the casing 8, and a bottom outlet 11 formed in the casing 8 that leads to a carburetor 2. The casing 8 contains a filter element 10 and a top cover secured to the casing by fasteners 7. Air flowing into the casing 8 from the inlet 13 can reach the outlet 11 only after it flows through the filter 10.

Within the casing 8, closely adjacent the inlet 13, extends a partition 9, and the partition 9 with the adjacent portion of the casing 8 defines an inlet passage 12. The passage 12 leads from the inlet 13 to an outlet 14, which is smaller in cross section than the inlet 13, thereby increasing the rate of air flow at the outlet 14. The outlet 14 leads to a curved passage 15 formed by the side wall of the casing 8, which ends with a slit or narrow opening 16 formed in the side wall of the casing 8. The slit 16 opens into the atmosphere in the direction of the moving air or wind from the fan, and the edge portions of the slit overlap as shown in FIG. 4. The slit opening 16 is formed by an outer edge 18 and an inner edge 19 of the casing side wall, and the inner edge 19 extends upstream into the path of the air stream in the passage 15. The slit 16 is immediately downstream from the curved passage 15 and the inner edge 19 peels off or removes the outer layer of the high speed air moving out of the curved passage, and, of course, this outer layer contains substantially all of the dust and other particles in the air stream.

In operation, a portion of the cooling air from the engine fan is forced to flow while still at a high speed through the inlet 13 and the passage 12, and the air turns through the curved passage 15. Due to the higher mass and inertia of the dust particles, the dust moves outwardly to the outer side wall and the dust and some air are discharged into the atmosphere through the slit 16. The bulk of the air, thus cleaned, then passes through the filter element 10 and to the outlet 11 and the carburetor 2.

As stated above, the casing 8 is fastened to the side of the housing 1 and the inlet 13 opens directly into the fan housing 1, thereby making the construction compact. Downstream from the curved passage 15, the air stream is divided into a relatively clean primary flow portion that does through the filter 10 to the carburetor, and a relatively dirty secondary flow portion adjacent the radially outer side of the flow passage. The secondary flow portion is in the radially outer layer of the air stream and it is removed through the narrow slit opening 16.

What is claimed is:

1. An air cleaner for an air-cooled engine, the engine further including a cooling fan within a fan housing and the fan housing having an air outlet formed therein, said cleaner comprising a casing adapted to be attached to said fan housing, said casing having a side wall, an air inlet opening in said casing which is adapted to communicate with said air outlet of the fan housing and air flowing from said fan, through said air outlet and said air inlet opening and into said casing, an air passage formed within said casing and extending from said inlet opening along said side wall and air from said fan flowing through said passage, an air filter in said air passage, said passage including a curved portion between said air inlet opening and said air filter, and a slit opening formed in said side wall adjacent said curved portion.

2. An air cleaner according to claim 1, wherein the portion of said passage adjacent said curved portion is smaller in cross section than said inlet opening.

3. An air cleaner according to claim 2, wherein said slit opens into the atmosphere in the direction of the air from said curved portion such as to remove the outer layer of air.

4. An air cleaner according to claim 1, wherein said slit opens into the atmosphere in the direction of the air from said curved portion such as to remove the outer layer of air.

5. An air cleaner for an air-cooled engine, the engine having a fan housing, an engine cooling fan in the housing and delivering cooling air to the engine, the housing having an air outlet formed therein and a portion of the air from said fan entering said air outlet, said air cleaner comprising a cleaner casing adapted to be attached to said fan housing adjacent said air outlet, means in said casing forming a curved air passage having an inlet end and an outlet end, said inlet end being adapted to receive air from said outlet of said fan housing and air flowing from said fan, through said inlet end and through said air passage, and means adjacent and outlet end forming a primary air flow passage and a secondary air flow passage, said secondary air flow passage being adjacent the radially outer side of said curved air passage and having a substantially smaller air flow cross section than said primary air flow passage, and said secondary air flow passage leading to the atmosphere.

6. An air cleaner according to claim 5, wherein said curved air flow passage has a smaller flow cross section than said air outlet.

7. An air-cooled engine comprising a fan housing, an engine cooling fan in the housing and during operation producing high speed air through the housing for cooling the engine, the housing having an air outlet formed therein and a portion of said high speed air flowing through said outlet, an air cleaner comprising a cleaner casing attached to said fan housing adjacent said air outlet, means in said casing forming a curved air passage having an inlet end and an outlet end and said portion of said high speed air flowing through said passage, said inlet end being connected to receive air from said outlet of said fan housing, and means adjacent said outlet end forming a primary air flow passage and a secondary air flow passage, said secondary air flow passage being adjacent the radially outer side of said curved air passage and having a substantially smaller air flow cross section than said primary air flow passage, and said secondary air flow passage leading to the atmosphere.

* * * * *

REEXAMINATION CERTIFICATE (1326th)

United States Patent [19]

Shirai

[11] B1 4,537,160

[45] Certificate Issued Jul. 17, 1990

[54] AIR CLEANER FOR AN AIR-COOLED ENGINE

[75] Inventor: Tetsuaki Shirai, Kobe, Japan

[73] Assignee: Kawasaki Heavy Industries Ltd, Kobe, Japan

Reexamination Request:
No. 90/001,885, Nov. 6, 1989

Reexamination Certificate for:

| | |
|---|---|
| Patent No.: | **4,537,160** |
| Issued: | **Aug. 27, 1985** |
| Appl. No.: | **638,736** |
| Filed: | **Aug. 8, 1984** |

[30] Foreign Application Priority Data

Aug. 12, 1983 [JP] Japan ..... 58-125955

[51] Int. Cl.[5] ..... F01P 5/06

[52] U.S. Cl. ..... 123/41.58; 123/41.65; 123/198 E; 55/320; 55/385.3; 55/DIG. 28

[58] Field of Search ..... 123/41.58, 41.59, 41.65, 123/41.7, 198 E, 198 D; 55/315, 318, 320, 330, 385.3, 437, DIG. 28

[56] References Cited

U.S. PATENT DOCUMENTS

| | | | |
|---|---|---|---|
| 2,069,379 | 2/1937 | Moe | 55/330 |
| 3,155,082 | 11/1964 | Roorda et al. | 123/41.58 |
| 4,212,659 | 7/1980 | Magrini | 55/385 B |
| 4,233,043 | 11/1980 | Catterson | 123/198 E |
| 4,425,145 | 1/1984 | Reese | 55/385 B |

*Primary Examiner*—Noah Kamen

[57] ABSTRACT

This disclosure relates to an air cleaner for use in an air-cooled engine including a cooling fan within a fan housing. The cleaner is connected to draw air from the housing, and includes a casing having a side wall, an air inlet opening in the fan housing, an air passage formed within the casing and extending from the inlet along the wall, the passage including a curved portion, and a narrow opening formed in the wall adjacent the curved portion. The curved passage causes dust particles to move by reason of inertia to the radially outer side of the passage and the particles are removed through the narrow opening.

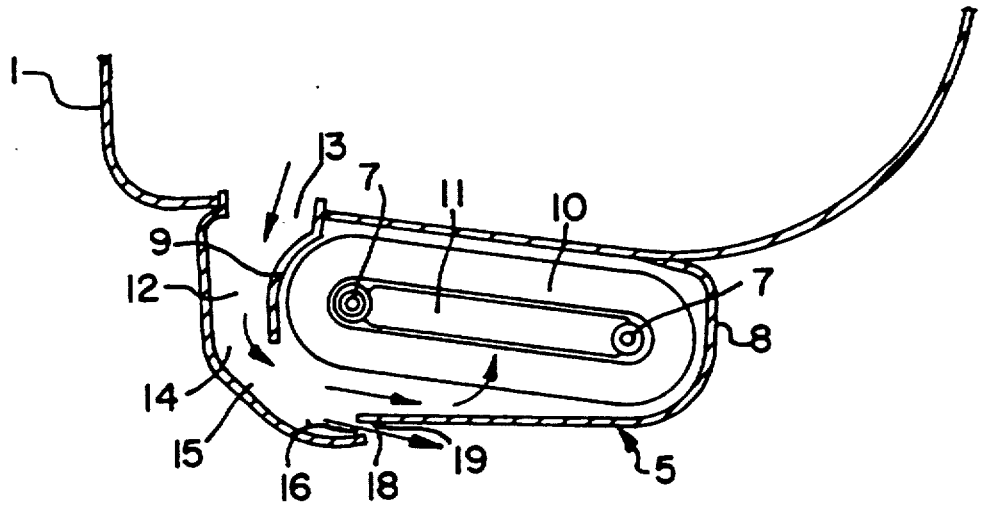

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1, 5, and 7 are cancelled.

Claims 2, 4 and 6 are determined to be patentable as amended.

Claim 3, dependent on an amended claim, is determined to be patentable.

New claims 8 and 9 are added and determined to be patentable.

2. [An air cleaner according to claim 1, wherein] *An air cleaner for an air-cooled engine, the engine further including a cooling fan within a fan housing and the fan housing having an air outlet formed therein, said cleaner comprising a casing adapted to be attached to said fan housing, said casing having a side wall, an air inlet opening in said casing which is adapted to communicate with said air outlet of the fan housing and air flowing from said fan, through said air outlet and said air inlet opening and into said casing, an air passage formed within said casing and extending from said inlet opening along said side wall and air from said fan flowing through said passage, an air filter in said air passage, said passage including a curved portion between said air inlet opening and said air filter, and a slit opening formed in said side wall adjacent said curved portion,* the portion of said passage adjacent said curved portion [is] *being* smaller in cross section than said inlet opening.

4. An air cleaner according to claim [1] *2*, wherein said slit opens into the atmosphere in the direction of the air from said curved portion such as to remove the outer layer of air.

6. [An air cleaner according to claim 5, wherein] *An air cleaner for an air-cooled engine, the engine having a fan housing, an engine cooling fan in the housing and delivering cooling air to the engine, the housing having an air outlet formed therein and a portion of the air from said fan entering said air outlet, said air cleaner comprising a cleaner casing adapted to be attached to said fan housing adjacent said air outlet, means in said casing forming a curved air passage having an inlet end and an outlet end, said inlet end being adapted to receive air from said outlet of said fan housing and air flowing from said fan, through said inlet end and through said air passage, and means adjacent said outlet end forming a primary air flow passage and a secondary air flow passage, said secondary air flow passage being adjacent the radially outer side of said curved air passage and having a substantially smaller air flow cross section than said primary air flow passage, and said secondary air flow passage leading to the atmosphere,* said curved air flow passage [has] *having* a smaller flow cross section than said air outlet.

*8. An air cleaner for an air-cooled engine, the engine further including a cooling fan within a fan housing and the fan housing having an air outlet formed therein, said cleaner comprising a casing adapted to be attached to said fan housing, said casing having a side wall, an air inlet opening in said casing which is adapted to communicate with said air outlet of the fan housing and air flowing from said fan, through said air outlet and said air inlet opening and into said casing, an air passage formed within said casing and extending from said inlet opening along said side wall and air from said fan flowing through said passage, an air filter in said air passage, said passage including a curved portion between said air inlet opening and said air filter, and a slit opening formed in said side wall adjacent said curved portion, said air filter having an elongated circular shape, said side wall of said casing including a curved portion and a straight portion downstream from said curved portion, said curved portion of said side wall forming said curved portion of said passage, and said slit opening being located adjacent the juncture between said curved and straight portions of said side wall.*

*9. An air cleaner for an air-cooled engine, the engine further including a cooling fan within a fan housing and the fan housing having an air outlet formed therein, said cleaner comprising a casing adapted to be attached to said fan housing, said casing having a side wall, an air inlet opening in said casing which is adapted to communicate with said air outlet of the fan housing and air flowing from said fan, through said air outlet and said air inlet opening and into said casing, an air passage formed within said casing and extending from said inlet opening along said side wall and air from said fan flowing through said passage, an air filter in said air passage, said passage including a curved portion between said air inlet opening and said air filter, and a slit opening formed in said side wall adjacent said curved portion, said air inlet opening and said air filter being positioned substantially at the same level.*

* * * * *